US010308482B2

(12) United States Patent
Michalke

(10) Patent No.: US 10,308,482 B2
(45) Date of Patent: Jun. 4, 2019

(54) TREAD ELEMENT FOR PEOPLE CONVEYOR COMPRISING A CANTILEVER ARM

(71) Applicants: Otis Elevator Company, Farmington, CT (US); Martin Michalke, Brunn am Gebirge (AT)

(72) Inventor: Martin Michalke, Brunn am Gebirge (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/571,570

(22) PCT Filed: May 6, 2015

(86) PCT No.: PCT/EP2015/059934
§ 371 (c)(1),
(2) Date: Nov. 3, 2017

(87) PCT Pub. No.: WO2016/177414
PCT Pub. Date: Nov. 10, 2016

(65) Prior Publication Data

US 2018/0155157 A1 Jun. 7, 2018

(51) Int. Cl.
*B66B 23/12* (2006.01)
*B66B 21/00* (2006.01)
(Continued)

(52) U.S. Cl.
CPC ..... *B66B 23/024* (2013.01); *B66B 23/026* (2013.01); *B66B 23/028* (2013.01); *B66B 23/12* (2013.01)

(58) Field of Classification Search
None
See application file for complete search history.

(56) References Cited

U.S. PATENT DOCUMENTS 994,879 A 6/1911 Seeberger
2,005,067 A * 6/1935 Graff-Baker ..... B66B 23/12 198/330
(Continued)

FOREIGN PATENT DOCUMENTS

CN 101224840 A 7/2008
CN 101293614 A 10/2008
(Continued)

OTHER PUBLICATIONS

International Search Report and Written Opinion for application PCT/EP2015/059934, dated Nov. 30, 2015, 13 pages.
(Continued)

*Primary Examiner* — Kavel Singh
(74) *Attorney, Agent, or Firm* — Cantor Colburn LLP

(57) ABSTRACT

A tread element (12) for a passenger conveyor (10); the tread element (12) comprising a tread (14) defined by a front side, a rear side, a first lateral side and a second lateral side;

a riser (16) comprising a riser panel (18) adjacent the rear side of the tread (14) and pivotably connected to the tread (14);

at least one tread chain axle (28) adapted to connect the tread element (12) to the at least one tread chain (22);

at least one tread roller (42) adapted to engage with a guide element (36) of the passenger conveyor (10) to adjust the position of the tread (14) with respect to the riser (16); and at least one cantilever arm (40) supported at its one longitudinal side by the tread chain axle (28) and supporting the tread roller (42) at its opposite longitudinal side.

20 Claims, 7 Drawing Sheets

(51) Int. Cl.

| | |
|---|---|
| ***B66B 21/02*** | (2006.01) |
| ***B66B 23/00*** | (2006.01) |
| ***B66B 23/08*** | (2006.01) |
| ***B66B 23/02*** | (2006.01) |

(56) References Cited

U.S. PATENT DOCUMENTS

| | | | | |
|---|---|---|---|---|
| 5,695,040 | A | 12/1997 | Watanabe et al. | |
| 6,082,520 | A | 7/2000 | Kleewein et al. | |
| 6,405,847 | B1 | 6/2002 | Cook et al. | |
| 6,405,848 | B1 * | 6/2002 | Babler | B66B 23/10 198/333 |
| 7,857,115 | B2 | 12/2010 | Lebrecque et al. | |
| 8,757,350 | B2 | 6/2014 | Ye et al. | |
| 2006/0144671 | A1 * | 7/2006 | Stuffel | B66B 23/12 198/326 |
| 2013/0112526 | A1 | 5/2013 | Makovec | |
| 2014/0124328 | A1 | 5/2014 | Woo | |
| 2014/0251728 | A1 | 9/2014 | Wurth et al. | |
| 2014/0251753 | A1 | 9/2014 | Turek et al. | |

FOREIGN PATENT DOCUMENTS

| | | | |
|---|---|---|---|
| CN | 103124685 | A | 5/2013 |
| DE | 2346266 | A1 | 3/1975 |
| DE | 10125686 | A1 | 1/2003 |
| EP | 0653373 | A2 | 5/1995 |
| EP | 1004539 | A1 | 5/2000 |
| ES | 2334630 | A1 | 3/2010 |
| GB | 505409 | A | 5/1939 |

OTHER PUBLICATIONS

Chinese First Office Action for application CN 201580079675.2, dated Nov. 29, 2018, U321059CN, 45 pages.

* cited by examiner

TREAD ELEMENT FOR PEOPLE CONVEYOR COMPRISING A CANTILEVER ARM

The present invention relates to a tread element for a people conveyor. The present invention also relates to an escalator comprising a tread band made up with a plurality of such tread elements. The people conveyor may be an escalator or a moving walkway.

Escalators are passenger conveyors that typically carry passengers between landings at different levels. Moving walkways are usually stepless people conveyors and are often used to carry passengers along levels extending horizontally or with only slight inclination.

The endless tread band is composed of several tread elements or tread plates (e.g. in the form of steps or pallets). A tread element includes a tread surface defined by a front side, a rear side and two lateral sides. The tread band is drivably connected to at least one tread chain (usually termed step chain or pallet chain). In many cases there are provided two lateral tread chains running in parallel along endless paths and the tread band is drivably connected to both tread chains.

The tread elements in conventional designs typically comprise essentially rigid box-shaped tread elements with a tread surface that is also referred to as the "tread". A front side of the tread elements is exposed in the inclined region of the escalator and referred to as the "riser." Each of the tread elements is typically fastened to the tread chain(s) by means of a tread chain axle. The tread chain axle usually extends through the tread element body and, in case of two tread chains arranged laterally, is connected to the tread chains with both of its free ends.

In the turnaround sections of the passenger conveyor both the tread chain links as well as the tread elements must travel along a transition curve in order to reverse their direction of travel. Usually, a guiding means is provided in the turnaround sections to guide both the tread elements and the tread chain links along their transition curves. Therefore, the bending radius of the transition curves must be chosen in such a way that the larger ones of the tread elements and the tread chain links still can follow the respective transition curve. For usual size of the tread elements, the tread elements define the minimum bending radius of the transition curve in the turnaround sections. Hence, such minimum bending radius becomes undesirably large in case the size of the tread elements is increased.

In a passenger conveyor, the individual tread elements typically move in a "channel" that is laterally limited by panel elements that are referred to as the "skirt boards". These skirt boards are rigidly arranged to the frame of the passenger conveyor, with the tread elements moving relative to these (stationary) skirt boards. The gap formed between the (moving) tread elements and the (stationary) skirt boards needs to be kept very small for safety reasons, so as to reliably ensure that no objects are pulled into this gap and become trapped therein. The most common risk is that parts of clothes, e. g. shoes or scarves, are pulled in this gap, and body parts of passengers are injured.

The requirement to ensure a very narrow gap is associated with a high maintenance expenditure. In certain instances, it is entirely impossible to fulfill the safety requirements with respect to a narrow gap.

DE 23 46 266 A1 discloses an escalator using pivotable lateral skirt panels moving together with the tread elements. Each step of the escalator is connected to the step chain via a respective step chain axle, and has mounted thereto a pair of lateral skirt panels. The skirt panels are supported by the step chain axles by which the respective step and the steps adjacent to it are connected to the step chain. Thereby, the lateral skirt panels perform a pivot movement with respect to the respective tread surface of the step corresponding to the rising/lowering of the step riser, as the steps travel in the inclined/horizontal sections of the endless transportation path. This construction, however, requires that both the lateral skirt panels and the step chain links have the same length as the tread surfaces of the steps, and in consequence leads to large bending radii in the turnaround sections.

The above described goal of providing a transition curve with a bending radius as small as possible in the turnaround sections becomes even more challenging in case lateral skirt boards moving together with the tread elements are to be used, since in addition to space for the tread elements also space for the lateral skirt boards is needed in the turnaround sections.

It would be beneficial to have available an alternative construction of tread elements for a passenger conveyor, which construction needs less space, particularly in the turnaround sections of the tread band, but still allows for sufficient closure of a gap formed at lateral sides of the tread elements.

Embodiments disclosed herein provide a tread element for a passenger conveyor; the tread element comprising a tread defined by a front side, a rear side, a first lateral side and a second lateral side; a riser comprising a riser panel adjacent the rear side of the tread and pivotably connected to the tread; at least one tread chain axle adapted to connect the tread element to the at least one tread chain; at least one tread roller adapted to engage with a guide element of the passenger conveyor to adjust the position of the tread with respect to the riser; and at least one cantilever arm supported at its one longitudinal side by the tread chain axle and supporting said tread roller at its opposite longitudinal side.

Further, embodiments disclosed herein provide a passenger conveyor, particularly an escalator or a moving walkway, comprising an endless tread band formed by a plurality of the tread elements connected to each other and driven by at least one tread chain between a downstream and an upstream turnaround section, the tread elements having a configuration as described herein. Said people conveyor further comprises: a drive configured to engage the drive chain such as to drive the drive chain around a first endless path between the first and second turnaround sections; a first guide element for guiding movement of the tread chain along the first endless path between the first and second turnaround sections; and a second guide element for guiding movement of the tread rollers along a second endless path between the first and second turnaround sections; the second guide element having a configuration such that the second endless path extends completely inside or completely outside the first endless path in a side elevation view.

Particular embodiments of the invention will be described by way of example in more detail below with reference to the figures.

FIG. 1 is a schematic view of a passenger conveyor in the configuration of an escalator, according to an embodiment, showing a plurality of consecutive tread elements having a bucket type design with risers comprising left and right lateral side panel members pivotably supported with respect to treads, the tread elements forming a tread band traveling in an upper transition section of their endless travel path.

Figure 5:
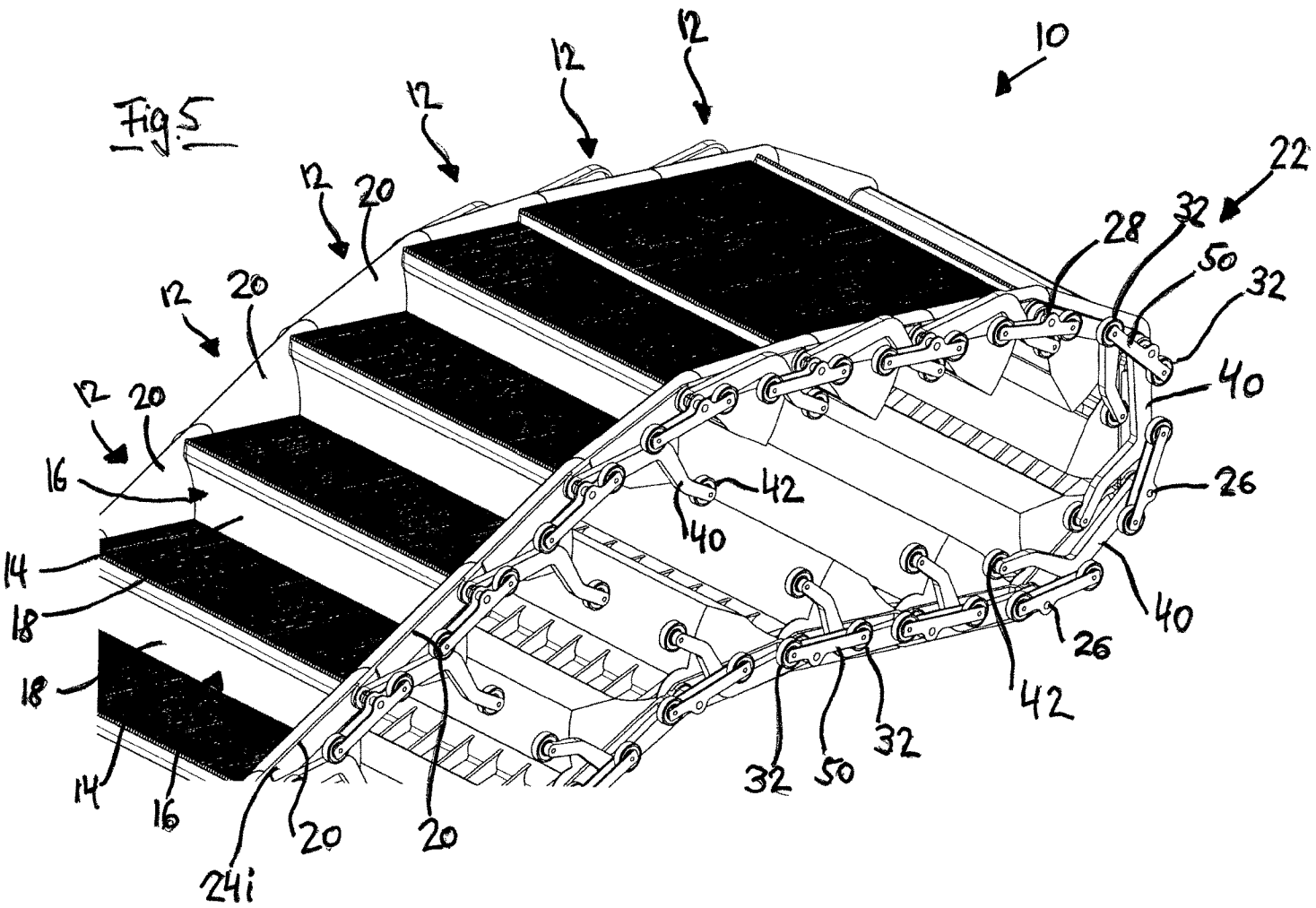

FIG. 5 is a schematic view of a passenger conveyor in the configuration of an escalator, according to a further embodiment, showing a plurality of consecutive tread elements having a bucket type design with risers comprising left and right lateral side panel members pivotably supported with respect to treads, the tread elements forming a tread band traveling in an upper transition section and an upper turnaround section of their endless travel path.

Figure 6:
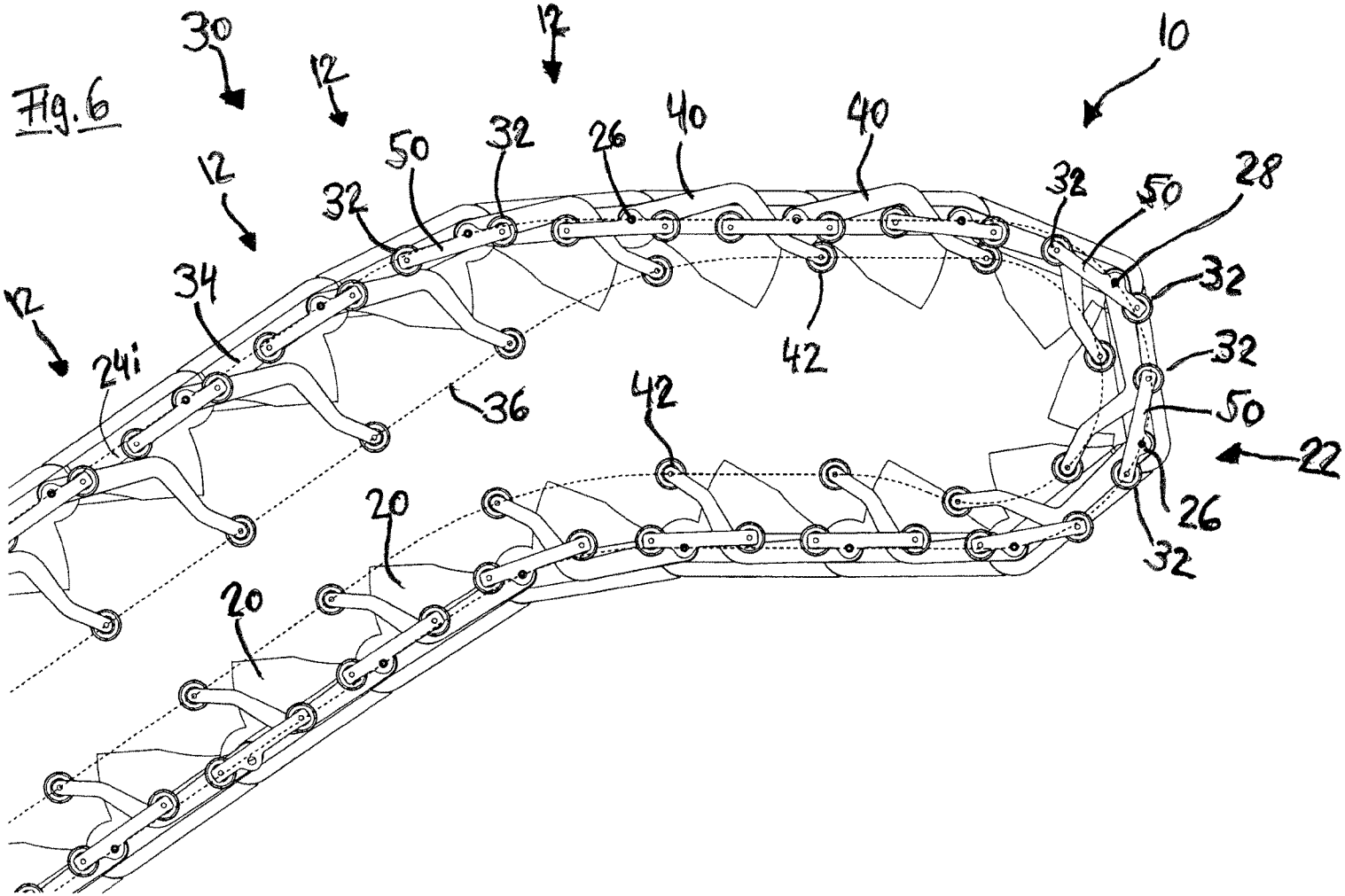

FIG. 6 is a schematic side view of an escalator having a tread band as shown in FIG. 5 in the upper transition section and upper turnaround section with the tread chain links omitted for clarity.

Figure 7:
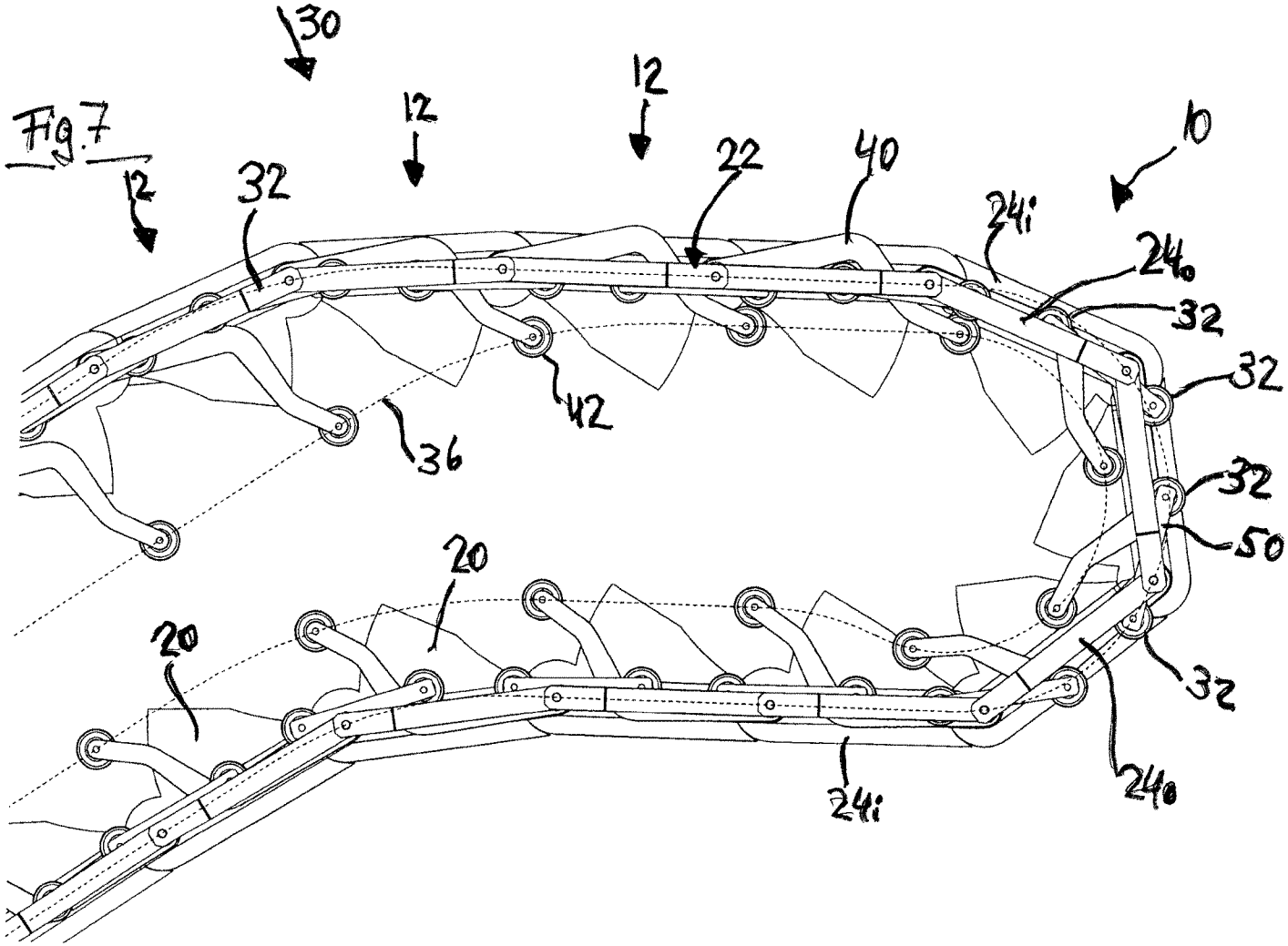

FIG. 7 is a schematic view similar to FIG. 6, but including the tread chain links.

The embodiments shown in the figures and described below relate to tread elements 12 for a people conveyor 10 in the form of an escalator. Although not shown explicitly, other embodiments might relate to tread elements for a people conveyor in the form of a moving walkway. Escalators are passenger conveyors that typically carry passengers between landings at different levels along a load path forming steps. Moving walkways are usually used to carry passengers along a generally flat load path extending horizontally or with only slight inclination. Tread elements 12 in an escalator are usually called "step elements" or "steps", and hence the term step or step element will be used hereinafter instead of the term tread or tread element. In case of a moving walkway, the tread elements 12 usually would be referred to as "pallet elements" or "pallets".

Throughout all figures, corresponding elements and characteristics are identified by the same reference symbols. Therefore, explanations regarding a specific FIG. generally also apply to each other figure. They are not repeated expressly with respect to all figures.

Figure 1:
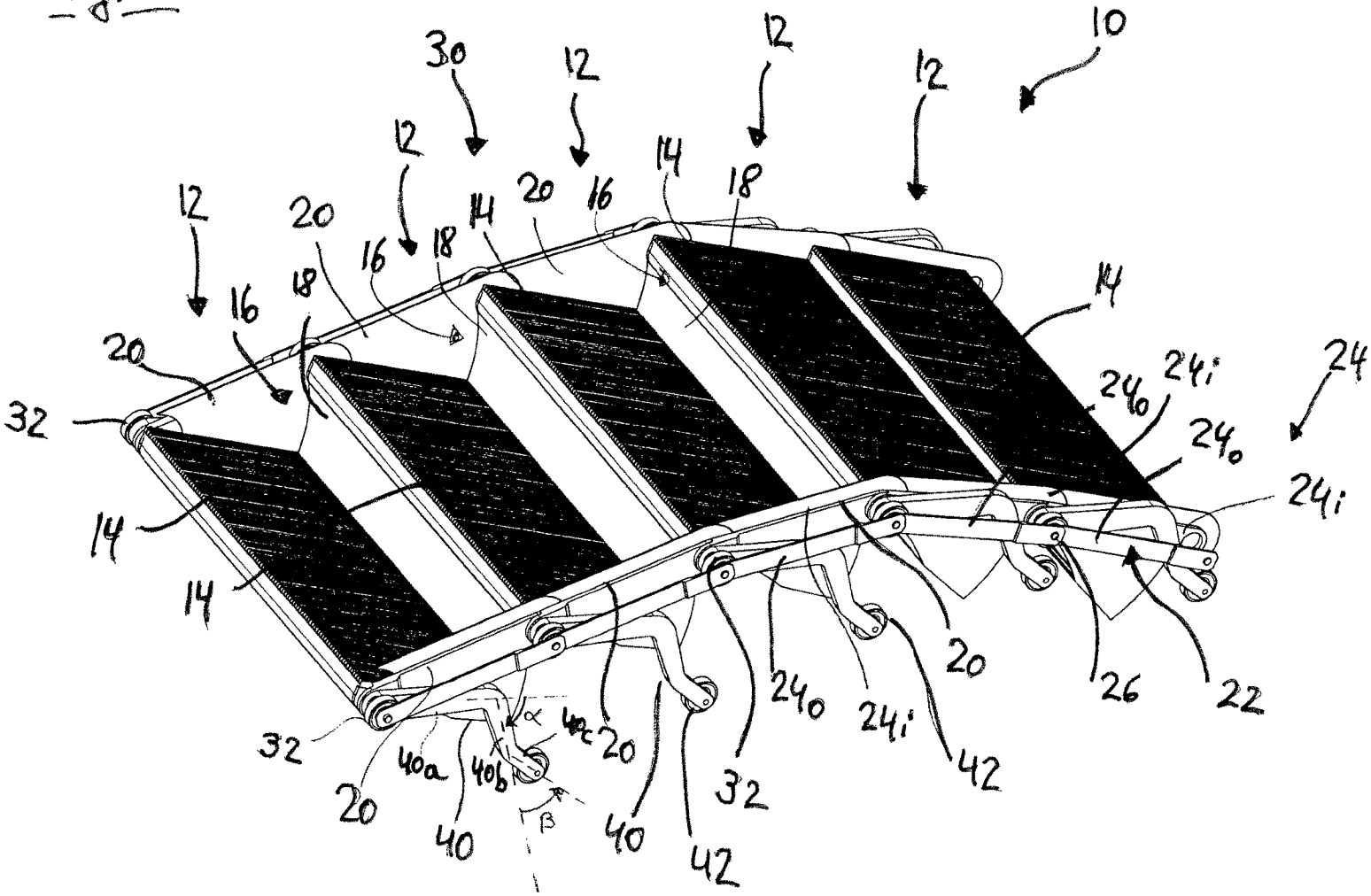

FIG. 1 shows a schematic view of the step elements 12 of an escalator 10 according to an embodiment. Each step element 12 includes a tread plate or tread 14 defined by a front side, a rear side and two lateral sides. FIG. 1 shows an arrangement of a plurality of consecutive step elements 12 comprising a tread plate or tread 14 and a riser 16. Riser 16 extends vertically from the rear side of the tread and has a bucket type design with lateral side panels 20 extending along lateral sides of the tread 14. Riser 16 is movable with respect to the tread 14. Particularly, riser 16 is pivotably supported around a pivot located near the front side of the tread 14. Riser 16 comprises a concave riser panel 18 extending in vertical direction along a back side of the tread 14, and left and right lateral side panels 20 extending from the riser panel 18 in right angles along left and right lateral sides of the tread 14. The riser panel 18 and the lateral side panel 20 are fixedly connected to each other, or even formed integrally with each other. Moreover, riser 16 comprises a bottom panel 38 (not shown in FIG. 1, see FIGS. 3 and 4) extending essentially horizontally from the concave riser panel 18 towards the front side of the tread 14. Bottom panel 38 is fixedly connected to, or formed integrally with, the lower edges of the concave riser panel 18 and the lateral side panels 20. Particularly, the riser panel 18 may have a cylindrical shape with an axis of the riser panel 18 being congruent to the pivoting axis of the tread 14 with respect to the riser 18. Thereby, the tread 14 may rotate with respect to the riser 16, when the step element 12 travels in differently inclined sections of the its travel path.

An endless tread band 30 (in case of an escalator usually referred to as step band) is composed of a plurality of step elements 12 connected to each other to form an endless chain. FIG. 1 shows the step elements 12 forming an endless step band 30 while traveling in an upper transition section of the escalator 10 in which the step elements 12 travel in from an inclined section to a horizontal section close to an upper landing. It is to be understood that the section of the step band 30 shown in FIG. 1 is exemplary and that the same, or corresponding, considerations apply to other sections of the endless step band 30 where the step elements 12 travel in other sections along their travel path as well, e.g. a lower transition section, an upper turnaround section, or a lower turnaround section (all not shown). The step band 30 is drivably connected to two lateral tread chains 22 (in an escalator usually referred to as a step chain, only one of these step chains is visible in FIG. 1) running in parallel along endless paths.

Figure 3:
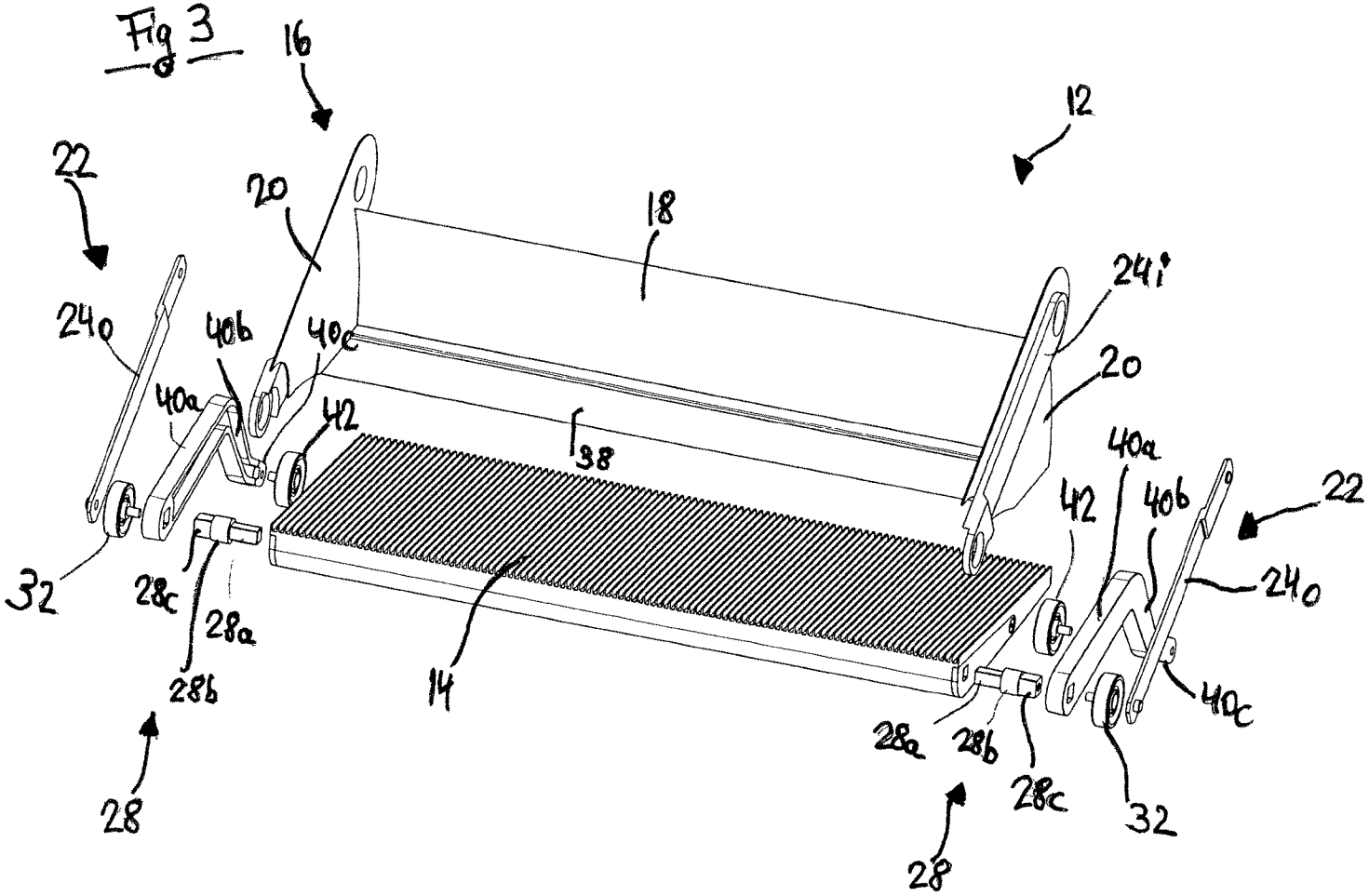
FIG. 3 is an exploded view showing individual components forming the tread element, and a drive chain link in the embodiment of FIGS. 1 and 2.
Figure 4:
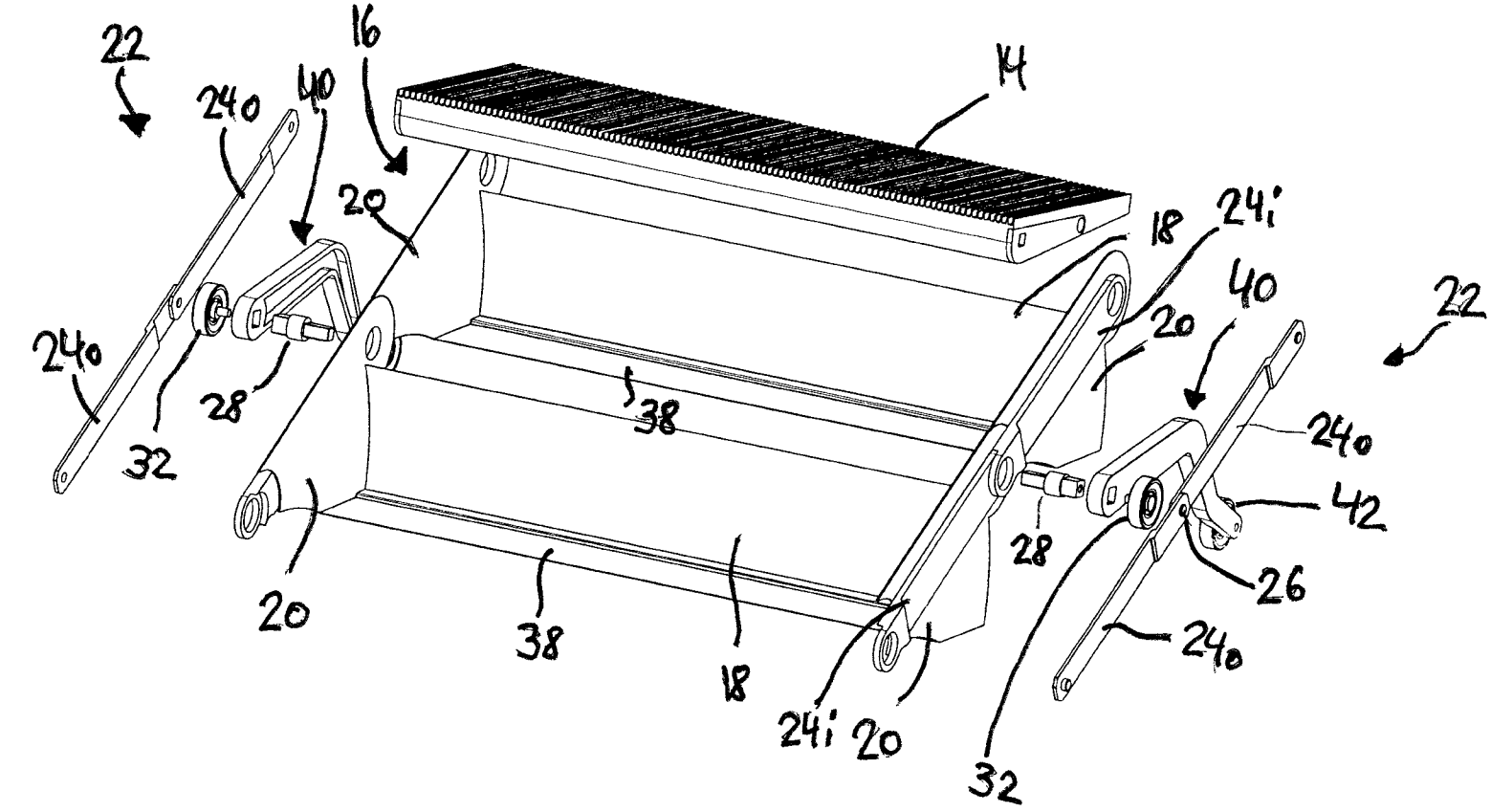
FIG. 4 is an exploded view showing individual components forming two consecutive tread elements connected together to form a tread band, and two consecutive drive chain links according to the embodiment of FIGS. 1 to 3.

As shown in FIG. 1, the step elements 12 are drivably connected to step chain 22 made up with tread chain links **24*i*, 24*o* (in case of an escalator usually referred to as step chain links) connected to each other via tread chain pins 26 (in case of an escalator usually referred to as step chain pins), and connected to the step elements 12 via tread chain axles 28 (not visible in FIG. 1, see FIGS. 3 and 4; in case of an escalator usually referred to as step chain axles). The step chain axles 28 each support a step chain roller 32. A laterally outer end section of each step chain axle 28 forms a respective step chain pin 26. As visible in FIG. 1, the step chain links 24 comprise pairs of outer and inner step chain link plates 24*o*, 24*i*. Outer step chain link plates 24*o* form a laterally outer side of the step chain 22. Inner step chain link plates 24*i* form a laterally inner side of step chain 22 adjacent to step elements 12. Step chain 22 formed by step chain links 24 has the same pitch as the step band 30 formed by step elements 12, i.e. the length of each step chain link 24 corresponds to the length of each step element 12. In the embodiment shown, inner step chain link plates 22*i* are formed by lateral side panels 20 of the risers 16 such that the step chain 22 is partly formed by step elements 12. Alternatively, inner step chain link plates 22*i* may be formed integrally with lateral side panels 20 of risers 16 or fixedly joint to lateral side panels 20 of risers 16**.

Although not shown in the figures, a passenger conveyor according to the embodiments typically also includes a frame, balustrades with movable handrails, and a drive system including the tread chain/step chain 22 for propelling the endless tread band (e.g. the step band 30 shown in FIG. 1 for the case of an escalator, or a pallet band in case of a moving walkway). The frame includes a truss section on both left and right hand sides of the frame. Each truss section has two end sections forming landings, connected by an inclined or—in case of a moving walkway—possibly also horizontal midsection. In case of an escalator as shown in the figures the inclined section has its steepest inclination in the middle section and is followed by upper and lower transition sections where the inclination transitions from maximum inclination to the horizontal and vice versa. Frequently, one of the landings houses the drive system or drive machine of the passenger conveyor positioned between the trusses. The step chain 22 travels in an endless loop between sheaves or sprockets (not shown) located at the upstream landing and the downstream landing, respectively. The step chain rollers 32 are supported and guided by a step chain guide assembly, e.g. a step chain guide rail, (see FIG. 2) fixed to the frame.

The drive system typically comprises the step chain 22, a step chain drive wheel (e.g. in the form of a sprocket or toothed wheel, not shown), and a drive motor (not shown). The step chain 22 travels an endless loop running from one landing to the other landing, and back. The step chain 22 is drivably connected to the step elements 12, e.g. via a step chain axle 28 which supports a respective step chain roller 32 of the step chain 22. The drive motor drives, directly or via a further transmission, a drive sprocket which is in a driving engagement with the step chain 22. Commonly the final drive is realized as one or a pair of chain drive sprockets located in a turnaround area. The drive sprockets are based on size of the step elements 12 and the step chain 22. Each drive sprocket is engaged by the step chain 22, e.g. by the step chain rollers 32 or by the step chain pins 26.

There also exist passenger conveyors in which propulsion of the step chain(s) 22 does not take place in the vicinity of the turnaround sections, but rather in other sections, e.g., the linearly inclined midsection (load section or return section). In passenger conveyors of this type, a turnaround plate or an essentially semicircular guideway may be provided instead of the chain sprocket such that the step chain rollers 32 or step chain pin 26 follow the path defined by the turnaround plate or the guideway. The step chain rollers 32 or step chain pins 26 are reversed from the load section into the return section of the passenger conveyor in the turnaround plate or the guideway. In this respect, the term turnaround section is intended to cover all types of constructions, e. g. chain turnaround wheels, turnaround guideways or turnaround plates.

Each of the step elements 12 is typically fastened to the step chain(s) 22 by means of at least one step chain axle 28. Conventionally, the step chain axle 28 extends through the body of the step element 12 and, in case of two step chains 22 arranged laterally, is connected to the step chains 22 with both of its free ends. In the embodiments shown herein, two step chain axles 28 are provided, each step chain axle 28 connecting the step element 12 to a drive chain 22 located on the left and right lateral sides of the step band 30, respectively (see FIGS. 3 and 4 for more detailed description of the step chain axle 28). Step chain axles 28 are connected to the tread 14 adjacent to, or at least close to, the front side of the tread 14. The risers 16 are pivotably supported via their lateral side panels 20 by the step chain axles 28 as well.

Each step element 12 comprises a pair of cantilever arms 40 (only the cantilever arms on one lateral side are clearly visible in FIG. 1, see e.g. FIGS. 3 and 4 showing the pair of cantilever arms 40 on each lateral side). Cantilever arms 40 are supported by step chain axles 28 at one end thereof and extend from the front side of tread 14 along the lateral side of tread 14 towards the back side. Cantilever arms 40 support at the opposite longitudinal end thereof a tread roller 42 (in the case of an escalator usually referred to as step roller). Cantilever arms 40 are supported by step chain axle 28 in a torque proof manner, and therefore pivoting movement of cantilever arm 40 will lead to a corresponding rotation of the step chain axle 28 supporting that cantilever arm 40. Since step chain axles 28 are connected to the treads 14 in a torque proof manner as well (see e.g. FIGS. 3 and 4) any pivoting movement of the cantilever arm 40 will result in a corresponding rotational movement of tread 14 with respect to riser 16 which is pivotably supported by step chain axle 28. This is clearly visible in FIGS. 3 and 4 which show that step chain axle 28 comprises three sections 28*a*, 28*b*, and 28*c* following each other in longitudinal direction. Step chain axle 28 has a different cross section in each of these sections. First section 28*a* is located at the laterally inner end of step chain axle 28 and has a torque proof shape with respect of a correspondingly shaped recess in tread 14, such as to connect in a torque proof manner to the correspondingly shaped recess formed in tread 14. A torque proof shape may be realized as a form-fit or positive fit shape of the first section 28*a* of step chain axle 28 with respect to the recess formed in tread 14 (e.g. a square cross section, or a tooth profile). Second section 28*b* adjacent to first section 28*a* has a cylindrical shape such as to rotatably support a correspondingly shaped hole or recess formed at the front end of lateral side panel 20 of riser 16. Second section 28*b* allows that a unit formed by tread 14, step chain axle 28 and cantilever arm 40 rotates with respect to the riser 16. Moreover, second section 28*b* acts as a hinge connecting two adjacent step elements 12 with each other to form the endless step band. Similar to first section 28*a*, third section 28*c* has a torque proof shape with respect to a correspondingly shaped hole or recess formed at first longitudinal end section 40*a* of cantilever arm 40, e.g. a square bar shape (or other torque proof shape) and is connectable in a form-fit or positive fit manner to a correspondingly shaped hole or recess formed at first longitudinal end section 40*a* of cantilever arm 40. Torque proof shaped section 28*c* of step chain axle 28 has a thicker cross section than torque proof shaped section 28*a*, in order to better withstand large torque and bending moments exerted by cantilever arm 40.

Step rollers 42 are rotatably supported by a second end section 40*c* of cantilever arms 40 and configured to engage a stationary guide means 36 (e.g. a step roller guide rail, see FIG. 2) provided by the conveyor. Thereby the angular orientation of the tread 14 may be controlled in such a way that the tread 14 remains horizontal, regardless of the inclination of the travel path of the step band 30.

The step elements 12 may be customarily manufactured from a material that can be easily processed, for example, a material that can be extruded such as aluminum, an aluminum alloy, or a plastic. The step chain axles 28 and the cantilever arms 40 are manufactured from a stronger material, for example steel.

Figure 2:
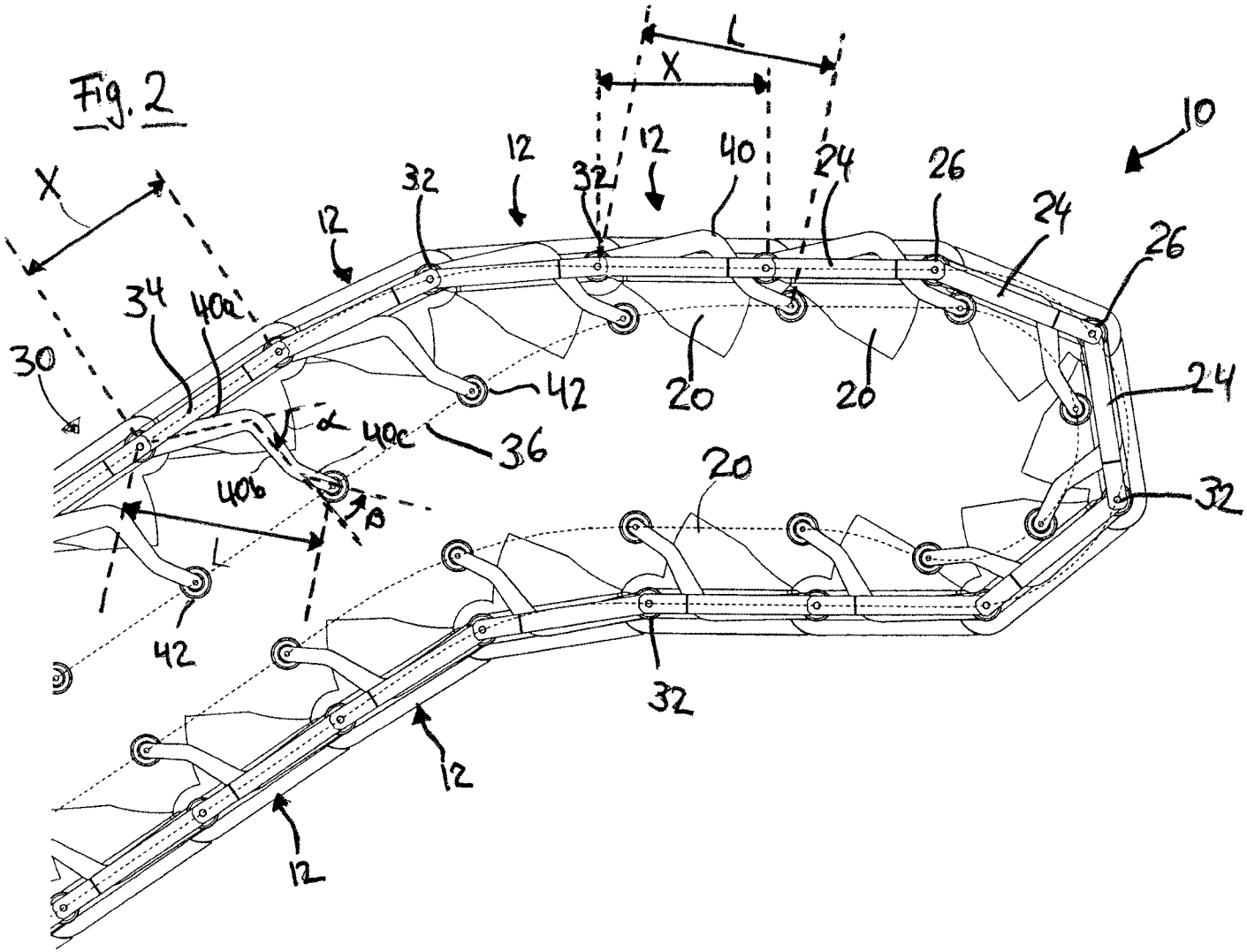
FIG. 2 shows a schematic side view of an escalator having a tread band as shown in FIG. 1 in the upper transition section and upper turnaround section.

In the turnaround sections of the passenger conveyor 10 where the endless travel path reverses direction, as well as in transition regions of the passenger conveyor 10 where the inclination of the travel path changes from horizontal to inclined, or vice versa, both the step chain links 22 as well as the step elements 12 must travel along a turnaround or transition curve in order to reverse their direction of travel. However, treads 14 of the step elements 12 must remain oriented horizontally throughout the load path in between the lower and upper landings. Usually, respective guiding means, e.g. guide rails, are provided along the travel path including the turnaround sections and the transition sections to guide both the step elements 12 and the step chain links along the turnaround curve or along the transition curve. In FIG. 2, the endless tracks defined by these guiding means are indicated by respective dashed lines 34 and 36.

Dashed line 34 indicates the endless track defined by a first guiding means, e.g. a guide rail fixed to the frame of the escalator, for guiding the step chain rollers 32 of the step chain 22. Dashed line 36 indicates the endless track defined by a second guiding means, e.g. a second guide rail fixed to the frame of the escalator, for guiding the step rollers 42 of the step elements 12. As can be seen in FIG. 2, in a side elevation view the endless track 36 defined by the second guiding means extends completely within the contour of the endless track 34 defined by first guiding means (although FIG. 2 only shows the upper half of the escalator 10 including the upper transition sections and the upper turnaround section, it being understood that the same considerations will apply for the lower half of the escalator including the lower transition sections and the lower turnaround section). This implies that the step rollers 42 never will cross the track 34 of the step chain rollers 32 when traveling along the endless track 36 defined by the second guiding means. Such design avoids any potential conflict or interferences between the step chain rollers 32 and the step rollers 42 when traveling along their respective endless tracks 34, 36. A particular advantage is that it is principally not necessary to arrange the step rollers 42 in a lateral plane outside the lateral plane in which the step chain rollers 32 or the step elements 12 travel. Thereby, the tread band 30 including its drive can be designed such as to require less space in lateral direction than conventional designs. This allows to fit the step band 30 including the step chain 22 into the space available in existing escalator installations. As the step rollers 42 always travel within the contour of the endless track 34 defined by the first guiding means guiding the step chain rollers 32, this design also is relatively compact when seen in a side elevation or side view as shown in FIG. 2. In contrast to conventional designs, no space is required outside the contour of the endless track 34 defined by the first guiding means.

In the embodiment shown the cantilever arm 40 has a specific shape which is designed to allow the step rollers 42 to travel within the contour of the endless track 34 defined by the first guiding means guiding the step chain rollers 32, regardless of whether the step elements 12 follow a horizontal or an inclined section of the travel path of step band 30. As shown in FIGS. 1 and 2, the cantilever arm 40 has a double cranked shape with a first crank and a second crank. The first crank is angled towards a first direction, while the second crank is angled towards a second direction opposite to the first direction, as indicated in FIGS. 1 and 2 by the opposite direction of arrows designating the first crank angle $\alpha$ and the second crank angle $\beta$. As a result of the double crank configuration, the cantilever arm 40 has a shape similar to the shape of a gooseneck. The double cranked shape of the cantilever arm 40 allows the cantilever arm 40 to be relatively long, thereby improving tilting stability. Nevertheless, cantilever arm 40 can be designed such as to stay within the contour defined by the step chain 24, and collisions of the cantilever arm 40 with adjacent structural elements, like step rollers 42 or step chain rollers 32, can be avoided throughout the endless travel path, particularly in the turnaround sections. Starting from the one longitudinal end supported by the step chain axle 28, the cantilever arm 40 comprises three sections 40*a*, 40*b*, and 40*c* following each other in the longitudinal direction of the cantilever arm towards the opposite end supporting the step roller 42. First section 40*a* forms a first longitudinal end section of cantilever arm 40 and comprises a hole or recess for connecting to the step chain axle 28 in a torque proof, particularly in a form fit or positive fit manner, and extends in a first direction (indicated by a dashed line in FIGS. 1 and 2) essentially towards the back side of the tread 14, i.e. towards the riser panel 18. First section 40*a* is followed by a second section 40*b* forming a central section of cantilever arm 40. Second section 40*b* is angled with respect to the first direction by a first angle $\alpha$. Angle $\alpha$ expresses the deviation of the longitudinal extension of second section 40*b* from the longitudinal extension of first section 40*a*, it be understood that a deviation to the left direction will be expressed by a positive value of first crank angle $\alpha$ and a deviation to the right direction will be expressed by a negative value of first crank angle $\alpha$. Second section 40*b* forming a central section of cantilever arm 40 is followed by a third section 40*c* forming a second longitudinal end section of cantilever arm 40 opposite to first section 40*a* and supporting the step roller 42. As indicated by dashed lines in FIGS. 1 and 2, third section 40*c* is again angled with respect to second section 40*b* by a second crank angle $\beta$. Second crank angle $\beta$ expresses the deviation of the longitudinal extension third section 40*c* from the longitudinal extension of second section 40*b*, it be understood that a deviation to the left direction will be expressed by a positive value of second crank angle $\beta$ and $\alpha$ deviation to the right direction will be expressed by a negative value of second crank angle $\beta$. As can be seen, the second section 40*b* is cranked with respect to the first section 40*a* towards a first direction which is opposite to a second direction to which the third section 40*c* is cranked with respect to the second section 40*b*. In other words, the second section 40*a* is cranked to the right with respect to the first section 40*a* (i.e. the first crank angle $\alpha$ has a negative value), while the third section is cranked with respect to the second section to the left direction (i.e. the second crank angle $\beta$ has a positive value). Further, it can be seen that the absolute value of the first crank angle $\alpha$ is somewhat larger than the absolute value of the second crank angle $\beta$ (i.e. the sum of $\alpha+\beta$ still yields a negative crank angle of the third section 40*c* with respect to the first section 40*a*), such that the third section 40*c* still is angled with respect to the first section 40*a*.

A configuration of the cantilever arm 40 as described above allows a relatively long extension of the cantilever arm 40 without interfering with the step chain axles 28 associated with adjacent step elements 12. As can be seen in FIGS. 1 and 2, the longitudinal extension L of the cantilever arm 40 (i.e. the distance between the first longitudinal end of the cantilever arm 40 supported by the step chain axle 28 and the opposite longitudinal end of the cantilever arm supporting the step roller 42) is larger than distance X between adjacent step chain axles 28. Typically, the longer the cantilever arm 40 is, the better the stability of the treads 14 will be when traveling in differently inclined sections along the load path of the people conveyor. Normally, when increasing the longitudinal extension L of the cantilever arm 40 to values larger than the distance X between adjacent step chain axles 28, the cantilever arm 40 will have to be positioned in a lateral plane outside the step elements 14 and outside the drive chain 22, in order to still allow the cantilever arm 40 to pivot from a position inside the track 34 defined by the first guiding means for the step chain rollers 32 to a position outside the track 34 when the step elements 14 travel from an inclined section of the travel path to a horizontal section of the travel path. Such an arrangement would consume significant space in lateral direction and would not allow to fit the step band and the drive chain within the lateral space provided by existing escalator installations. Reducing the longitudinal length of the cantilever arm 40 to values smaller than the distance X between adjacent step chain axles 28 would resolve such interference problems, but would inevitably lead to insufficient stability of the step elements 12 with respect to large unbalanced loads applied to the tread 14 in the load path. In contrast, the specific double crank configuration of the cantilever arm 40 according to the present embodiment avoids such problems, as the cantilever arm 40 is configured such that the track 36 of the step rollers 42 supported by the cantilever arm 40 does not have to cross the track 34 of the step chain rollers 32 when the step elements 12 travel from an inclined section of their endless track to a horizontal section.

The bottom panels 38 of the risers 16 according to the embodiment shown herein (see FIGS. 3 and 4) may provide additional support for the tread 14 when the step elements 12 travel along the steepest inclined sections of the endless travel path of the step elements 12, since the lower side of the tread 14 will abut the bottom panels 38 of the risers 16 when the step elements 12 travel along the steepest inclined sections. Therefore, when traveling in these steepest inclined sections, the tread will be supported by the bottom panels 38 of the riser and need not necessarily be supported by the cantilever arm 40 and the step roller 42, thereby increasing stability of the treads 14 with respect to unbalanced loads. In principle, it would even be possible to support the tread by the bottom panels 38 exclusively in the steepest section.

FIGS. 3 and 4 show that the cantilever arm 40 and the step chain roller 32 are both positioned in a gap formed in between the inner link plates 24*i* and the outer link plates 24*o* of the links 24 of the step chain 22. The cantilever arm 40 is positioned laterally inside the step chain roller 32. Thereby, the cantilever arm 40 is connected to the step element 12 (i.e. the tread 14) via a shortest possible connection provided by the section in between sections 28C and 28A of the tread chain axle 28. This allows to provide a relatively stable and stiff transmission of the relative large torque and bending moments exerted by the step roller 42 via the cantilever arm 40 to the tread element 12, in particular to the tread 14 and to the lateral side panels 20 of the riser. Due to the large longitudinal extension of the cantilever arm 40, such torque and bending moments may be relatively strong, and therefore may cause significant deformation and wear of the tread 14 and the lateral side panels 20 when the cantilever arm 40 would be positioned further outside in the lateral direction (e.g. laterally outside the step chain 22).

FIGS. 5 to 7 show a further embodiment of the step elements 12 of an escalator 10. This embodiment is similar to the embodiment shown in FIGS. 1 to 4. Particularly, the configuration of the step elements 12 including a tread plate or tread 14 defined by a front side, a rear side and two lateral sides, and riser 16 extending vertically from the rear side of the tread and 14 and having a bucket type design with lateral side panels 20 extending along lateral sides of the tread 14 is the same as in the embodiment of FIGS. 1 to 4. Also, the arrangement and configuration of cantilever arms 40 is the same as in the embodiment of FIGS. 1 to 4. To avoid repetition, the description of such components is not repeated again. Instead, reference is made to the detailed description of the embodiment above with respect to FIGS. 1 to 4 which fully applies to the embodiment of FIGS. 5 to 7 as well.

In the following, only some differences to the embodiment of FIGS. 1 to 4 are described in some more detail. The main difference of the embodiment shown in FIGS. 5 to 7 with respect to the embodiment of FIGS. 1 to 4 is that the step chain 22 is not supported by single step chain rollers 32 supported by step chain axles 28, as is the case in the embodiment of FIGS. 1 to 4. Rather, in the embodiment of FIGS. 5 to 7 each of the step chain axles 28 pivotably supports a respective step chain roller supporting element 50. Step chain roller supporting element 50 itself supports at least two step chain rollers 32 mounted at its opposite longitudinal ends. Thereby, the effective number of step chain rollers 32 supporting and guiding the step chain, as well as engaging with the drive sprocket is increased by a factor of at least two compared to the number of step chain links 22. Hence, the load to be supported by each single step chain roller 32 is reduced with respect to the embodiment of FIGS. 1 to 4. E.g. in case step chain roller supporting element 50 supports a pair of step chain rollers 32 in equal distances to the chain pin 26, the load to be supported by each step chain roller 32 will be reduced to a half. Moreover, also the effective step chain pitch is reduced compared to the step chain 22 shown in FIGS. 1 to 4. The reduction in effective step chain pitch results in an efficient suppression of the polygon effect which otherwise might become important for configurations where the step chain pitch becomes large and correspondingly the number of teeth on the drive sprocket becomes small.

FIG. 5 shows in a perspective view a plurality of consecutive step elements 12 traveling in an upper transition section and an upper turnaround section of their endless travel path in an escalator. The outer chain links 240 of the step chain 22 are omitted in FIG. 5 for better identification of the chain roller supporting elements 50. FIGS. 6 and 7 are schematic side elevation views of an escalator having a configuration as shown in FIG. 5 with the step elements 12 traveling in the upper transition section and upper turnaround section. In FIGS. 6 and 7, the tread elements 12 are omitted for better identification of the chain roller supporting elements 50. The position and orientation of the step elements 12 can be seen in FIGS. 6 and 7 from the lateral side panels 20 and the cantilever arms 40 with tread rollers 42. In FIG. 6 the outer step chain chain links 24*o* are omitted as well for clarity. FIG. 7 is a schematic view corresponding to FIG. 6, but including the outer tread chain links 24*o*.

As visible in FIGS. 5 to 7, the step chain 22 comprises a plurality of chain links 24, which are pivotably linked to each other by respective chain pins 26. Each chain pin 26 links two adjacent end portions of pairs of adjacent inner and outer chain link plates 24*i*, 24*o*. The chain pins 26 are formed by outer ends of the step chain axles 28. Each of the step chain roller supporting elements 50 is supported by a respective step chain axle 28 and is positioned in the gap formed in between inner step chain link plates 24*i* and the corresponding outer step chain link plates 24*o* forming the step chain links 24. Each step chain supporting element 50 supports two step chain rollers 32.

In the embodiment shown the step chain 22 comprises a single step chain link 24 per tread element 12, i.e. the number of step chain links 24 is identical to the number of step elements 12. However, by supporting the step chain rollers 32 by the step chain roller supporting elements 50, two step chain rollers 32 can be provided per step chain pin 26. Thus, each tread element 12 of the people conveyor 10 is supported by two step chain rollers 32 of the step chain 22.

As a consequence, the pitch of the step chain 22 is identical to the pitch of the step band formed by the tread elements 12 (the step chain 22 comprises only a single step chain link 24 for each of the tread elements 12), but the step chain 22 comprises twice as many step chain rollers 32 as step chain links 24. Hence, the load to be carried by each of the step chain rollers 32 is considerably reduced, as it may be shared by twice the number of step chain rollers 32.

A configuration where the pitch of the step chain 22 is identical to the pitch of the step elements 12 has the particular advantage that the sizes of the gaps formed in between two consecutive step elements 12 remain constant along the load track of the people conveyor. This helps in reducing the risk of objects being entrapped in such gaps.

For a more detailed description of a drive chain using supporting elements 50 of the type shown in FIGS. 5 to 7, reference is made to applicant's co-pending international patent application No. PCT/EP2014/076209. The disclosure of that patent application is incorporated herein by reference.

Basically, the embodiments disclosed herein suggest tread elements for a passenger conveyor, particularly for a passenger conveyor of the type comprising an endless tread band formed by a plurality of the tread elements connected to each other and driven by at least one tread chain between a downstream and an upstream turnaround section. The tread element allows to reduce the risk of goods being entrapped into a gap formed between moving parts of a tread element in a people conveyor, like an escalator or a moving walkway. A reduction of gaps is basically achieved by applying the principle of so-called pivoting lateral side panels, i.e. the tread elements are provided with lateral side panels moving together with the tread and riser of the tread element, thereby eliminating most of the gaps formed in between parts moving along the travel path of a people conveyor (like tread elements) and stationary parts (e.g. balustrades). Although the riser remains movable with respect to the tread, the risk of objects becoming entrapped into gaps formed between the tread and the riser is relatively low, since the tread and riser move together along the travel path and only relatively slowly pivot with respect to each other due to different inclination of the travel path in different sections of the people conveyor. The riser and the tread rotate relative to each other only in the transition sections where inclination of the tread band changes. The embodiments disclosed herein provide for a much more efficient use of available space for guiding and supporting the tread elements of such pivoting lateral sides type people conveyor, thereby allowing to fit the people conveyor into the space restrictions imposed by existing installations to be modernized.

The tread element suggested herein particularly is used as one tread element in an endless tread band formed by a plurality of the tread elements connected to each other and driven by at least one tread chain between a downstream and an upstream turnaround section. The tread element comprises: a tread plate or tread defined by a front side, a rear side, a first lateral side and a second lateral side; a riser comprising a riser panel adjacent the rear side of the tread and pivotably connected to the tread; at least one tread chain axle adapted to connect the tread element to the at least one tread chain; at least one tread roller adapted to engage with a guide element of the passenger conveyor to adjust the position of the tread with respect to the riser; and at least one cantilever arm supported at its one longitudinal side by the tread chain axle and supporting said tread roller at its opposite longitudinal side.

Particular embodiments may include any of the following optional features, alone or in combination with each other, unless it is specified explicitly that a particular feature is an alternative to another feature.

Usually, the tread element is drivably connected to at least one endless tread chain, while the tread chain is driven around a first and a second turnaround section by means of a drive. In a typical configuration, the tread chain comprises a plurality of tread chain links connected to each other via respective tread chain pins. Tread chain rollers may be supported by at least part of the tread chain pins, in order to support and guide the tread chain along an endless travel path. The tread chain rollers and/or the tread chain pins may be configured to engage with the drive in order to transmit the driving forces to the tread chain. In particular embodiments, tread chain supporting elements carrying a plurality of tread chain rollers may be supported by at least part of the tread chain pins. In some embodiments each of the tread chain pins may support a tread chain roller or a tread chain supporting element. At least those of the tread chain pins supporting a tread chain roller or a tread chain supporting element are connected to a respective tread element via the tread chain axle, e.g. by connecting the tread chain pin to the tread chain axle of that tread element or by extending the tread chain pin laterally such as to support the tread element and thereby form the tread chain axle of that tread element. Typically, the tread chain rollers engage with a further guide element (e.g. a guide rail) of the people conveyor such as to support and guide the tread chain along its endless travel path. The tread chain rollers and/or the tread chain pins may engage the drive (e.g. a drive sprocket) for driving the tread chain and the tread elements along the endless travel path.

In particular embodiments the riser may comprise a first lateral panel extending along the first lateral side of the tread and a second lateral panel extending along the second lateral side of the tread. Then, the first lateral panel may be supported pivotably with respect to the tread by a first pivot located on the first lateral side of the tread, and the second lateral panel may be supported pivotably with respect to the tread by a second pivot located on the second lateral side of the tread.

In particular embodiments, the first and second pivots will be located opposite to each other adjacent to the front side of the tread. Thereby, the riser panel is supported pivotably around a pivot located at, or in the vicinity to, the front side of the tread in front of the riser, i.e. the tread usually forming the adjacent lower tread with respect to the riser panel of the riser. The riser panel may have a concave shape such as to allow a pivoting movement of the riser panel with respect to the tread around the pivot while keeping the size of a gap between the riser panel and the tread constant (and small).

Further, the riser may comprise a bottom panel extending from the riser panel towards the front side of the tread. Such bottom panel may extend essentially in horizontal direction and may connect the first and second lateral side panels with each other. The riser panel, the two lateral side panels, and the bottom panel may be fixedly connected to each other, or even formed integrally with each other, such that the riser will have the shape of a bucket formed by the riser panel, the two lateral side panels, and the bottom panel. When installed in the endless tread band of a people conveyor, the bottom panel of the riser will be located below the tread by which the riser is pivotably supported. The bottom panel of the riser may abut the lower side of the tread, thus supporting the tread, at least in parts of the endless track followed by the tread elements, e.g. in the steepest inclined section of an escalator. Thereby, the tread may be regarded as being supported by the bucket formed by the riser. The cantilever arm with the tread roller supported at its end opposite to the tread chain axle will engage with a stationary guiding element of the people conveyor, such as to induce a pivoting movement of the tread with respect to the riser as the tread element moves along its endless path in sections where the inclination of the travel path changes (e.g. in the transition regions of an escalator where the travel path changes from a horizontal direction without steps between adjacent treads, to an inclined direction where steps are formed in between adjacent treads, or vice versa).

In particular embodiments, the tread element may comprise a pair of cantilever arms. One of these cantilever arms may be located on each lateral side of the tread. Thereby, each cantilever lever arm may provide the same pivoting movement of the tread with respect to the riser as the tread element moves along its endless travel path thus increasing stability. Typically, the cantilever arm will extend in a direction along the lateral side of the tread, i.e. essentially parallel to the lateral side of the tread and the lateral side panel. The cantilever arm will extend from the pivot towards the back side of the tread where the riser panel is located.

In order to provide stable and precise adjustment of the position of the tread with respect to the riser, as appropriate in different sections of the endless travel path, the cantilever arm should have a sufficient length to allow a pivoting movement of the tread with respect to the riser even in a situation where the tread element is heavily loaded. The longer the cantilever arm, the better can the tread roller stably support the tread in the desired position with respect to the riser, even in situations where the tread is loaded in an unbalanced way. However, unfortunately in case the cantilever arm has a length in the order of the distance between adjacent tread chain axles, severe interferences arise, since during traveling of the tread element along the endless path of a people conveyor it is usually required that the cantilever arm moves from a position inside the endless path described by the tread chain axles to a position outside the endless path described the tread chain axles. Basically, such restriction sets an upper boundary to the possible maximum length of the cantilever arm to values smaller than the distance between adjacent tread chain axles.

According to embodiments set out herein, an alternative solution is provided in that a tread element is suggested wherein the cantilever arm has a cranked or bent shape. The term cranked or bent as used herein refers to a geometry where the cantilever arm changes its longitudinal extension from a first direction into a second direction angled with respect to the first direction. Depending on a particular design, such change in direction of the cantilever arm may be more sharply or more smoothly. In that sense, the terms "cranked shape" and "bent shape" are intended to refer both to such geometry of the cantilever arm. Particularly, a first end section of the cantilever arm located at the longitudinal side of the cantilever arm supported at the tread chain axle may be angled with respect to an adjacent second section of the cantilever arm. The second section may include a second longitudinal end section of the cantilever arm which supports the tread roller. In particular embodiments, the second section may be angled with respect to the first longitudinal end section at an angle ranging between 20 and 160 degrees, particularly between 45 and 135 degrees, more particularly between 70 and 110 degrees. In some embodiments, the second section may be linear, such that the cantilever arm will have a single cranked or bent shape. In other embodiments, the second section may have a cranked or bent shape as well, such that the cantilever arm will have two or more cranks or bents. In particular, the second section may include a central section of the cantilever arm cranked or bent with respect to the first longitudinal end section as described before, and an opposite longitudinal end section supporting the tread roller. The opposite longitudinal end section may be cranked or bent with respect to the central section in a direction opposite to the crank or bent formed by the central section with respect to the first longitudinal end section. Typically, the angle formed in between the opposite longitudinal end section and the central section will be less than the angle formed in between the first longitudinal end section and the central section, such that the opposite longitudinal end section will still be cranked or bent with respect to the first longitudinal end section. As a result, the cantilever arm will have a shape similar to a goose-neck. It has turned out that, by additionally bending the cantilever arm in the way described herein, configurations are possible where the opposite longitudinal end section of the cantilever arm supporting the tread roller may remain within the interior of a contour prescribed by the tread chain rollers throughout the endless travel path to be completed by each tread element.

Therefore, by using a suitably cranked or bent shape of the cantilever arm, the cantilever arm can be relatively long, in particular may have an extension longer than the gap available in between two adjacent tread chain axles of the endless tread band. A distance between the tread chain axle supporting the cantilever arm and the tread roller supported by the same cantilever arm may be larger than a distance between the tread chain axle of the tread element and the tread chain axle of an adjacent tread element (also called the chain pitch) in the endless tread chain of a people conveyor. This allows to improve stability of the tread elements even situations where inclination of the travel path is very steep.

In some embodiments, the tread element may comprise a pair of step chain axles, each step chain axle supporting a respective one of the cantilever arms on opposite lateral sides of the tread element.

Particularly, the tread chain axle may be connected to the tread in a torque-proof manner and may be connected to the cantilever arm in a torque-proof manner as well. Particularly, the riser may be pivotably supported by the tread chain axle. Therefore, any rotation of the cantilever arm with respect to the riser will lead to a corresponding pivoting movement of the tread with respect to the riser. This allows the tread rollers to adjust the position of the tread with respect to the riser according to the inclination of the inclination of the load path of the people conveyor, particularly in the transitions regions of an escalator.

The tread chain axle may have different sections in longitudinal directions, each of these sections having a different cross section. The tread chain axle may have a first section at an inner lateral end thereof which is configured to fit to the tread in a torque-proof manner (e.g. in a form fit or positive fit manner). E.g. the first section may have a square bar, triangular bar or tooth shape mating with a corresponding square, triangularly, or toothed shaped recess in the tread in a form fit or positive fit manner. The tread axle may have a similarly shaped third section configured to fit with a correspondingly shaped recess or hole formed in the cantilever arm in a torque-proof (e.g. in a form fit or positive fit manner). In between the first and third section, the tread chain axle may have a second section having a cylindrical shape configured to mate with a corresponding cylindrical hole formed in the first or second lateral side panel of the riser. Thereby, the second section of the tread axle pivotably supports the first or second lateral side panel of the riser in the form of a hinge.

The tread chain may comprise tread chain links connected to each other by tread chain pins, the tread chain axle including a section adapted to engage with one of the tread chain pins or forming one of the tread chain pins. In particular embodiments, the tread chain axle may include a fourth section located at the longitudinal end opposite to the tread element (i.e. the laterally outer longitudinal end) which is formed as the tread chain pin connecting adjacent links of the tread chain with each other. Alternatively, the fourth section may be shaped to engage with the tread chain pins of the tread chain in a form fit manner and/or in a friction fit manner.

In some embodiments, the lateral side panels of the riser may be formed integrally with respective tread chain links.

Particularly, with the embodiments described herein, the tread chain links may have the same pitch as the tread elements, i.e. the links of the tread chain may have the same length, or a corresponding length, as the tread elements (the chain pitch being defined as length of the tread plus the thickness of the riser plus the size of gaps). In such embodiments, only one link of the tread chain will be provided for each of the tread elements. In such embodiments, usually each of the tread chain links will be connected to a corresponding tread element via a respective tread chain axle.

In order to save space in lateral direction and to reduce material, the tread elements may be used to form at least parts of the tread chain. Particularly, the lateral side panels of the riser may be used to form at least in part the links of the tread chain. In some embodiments, the lateral side panels of the riser may be connected to each other by the tread chain axles, and thus the lateral side panels form the links of the tread chain such that no separate step chain will be required.

In other embodiments, it may be more beneficial if the lateral side panels form only parts of the tread chain links. Such embodiments may e.g. provide an easier engagement of the tread chain with a drive sprocket. Particularly, in embodiments where the tread chain links are made up with pairs of link plates connected to each other by respective tread chain pins, the laterally inner link plate of each tread chain link may be formed by, or at least may be formed integrally with, the respective lateral panel member.

With a configuration of a tread chain where the tread chain links are made up with pairs of link plates connected to each other by respective tread chain pins, the cantilever arm and/or the tread chain roller may be positioned in a gap formed in between the two link plates of a pair of link plates forming a respective tread chain link. The cantilever arm and/or the tread chain roller will thus be sandwiched by the tread chain links in lateral direction.

Generally, the cantilever arm may be supported laterally inwardly of the laterally outer side of the tread chain.

The cantilever arm can be positioned as closely as possible to the tread by positioning the cantilever arm adjacent to the lateral side panel of the riser in case the lateral side panel forms, or is formed integral with, the inner link plate of the tread chain. In case the tread chain comprises inner link plates formed separately from the lateral side panels, a similarly close positioning of the cantilever arm to the tread is possible by positioning the cantilever arm adjacent to the inner link plates of the step chain. Such configuration allows to couple the cantilever arm and the tread via a short connecting element, i.e. the tread chain axle. The tread chain axle thus may have the configuration of a short stub axle. This is particularly advantageous since the cantilever arm, due to its considerable length, exerts large torsional moments and large bending moments to the tread chain axle and to the tread. By keeping the length of the tread chain axle between the first section non-pivotably connected to the tread and the third section non-pivotably connected to the cantilever arm short, any deformations caused be the torsional moments exerted by the cantilever arm can be kept as small as possible which results in a stiff mechanical connection such that wear is reduced and service life is increased.

In further embodiments, the tread chain roller may be supported on a laterally outer side of the cantilever arm, but still on a laterally inner side with respect to the laterally outer side of the tread chain. Also the tread chain roller is subject to relatively large forces mostly exerted by the engagement of the tread chain roller with the drive of the people conveyor, e.g. with a drive sprocket. Such driving forces are to be transferred from the tread chain roller to the tread via the tread chain axle as well. Driving forces introduced into the tread chain roller axle from the drive (e.g. a sprocket) and the tread chain roller will have to be transferred to both sides of the link plates of the tread chain, in the way of a crawler traction force. Only a relatively small force has to be transferred form the tread chain axle to the tread, in a case of two tread chains about half of the weight of the tread plate and half of the weight of the persons standing on the tread. The shorter the distance between the tread chain roller and the first section of the tread chain axle connected to the tread in a torque proof manner, the smaller can be kept bending moments exerted by the drive of the conveyor via the tread chain rollers to the tread chain axles. In case the tread chain roller is supported laterally outwardly of the laterally inner side of the tread chain and laterally inwardly of the laterally outer side of the tread chain, the engagement of the tread chain roller with the drive can be such that driving load is applied relatively symmetrically to the outer and inner tread chain link plates of the tread chain via the tread chain roller, since the tread chain roller is positioned symmetrically in between the outer and inner link plates of the tread chain.

In addition, space in lateral direction can be saved by supporting the tread chain via the tread chain rollers. The tread chain rollers may be adapted to engage a tread chain guiding element (e.g. a tread chain guide rail) of the people conveyor. Thereby, the tread chain roller, in addition to transferring the driving forces from the drive to the tread element, also supports and guides the tread elements along their endless path in between the two opposite turnaround sections. This saves space in lateral direction, since no additional supporting means (e.g. additional supporting rollers for engaging tread chain guide rails of the people conveyor) are required which otherwise would have to be provided laterally outside of the tread chain.

Further, the tread roller may be supported on a laterally inner side of the cantilever arm. The particular shape of the cantilever arm suggested herein allows to make the cantilever arm relatively long and thereby enhancing stability of the treads even in case the treads are loaded unsymmetrically. Despite the long extension of the cantilever arm, it can be avoided that the endless path to be travelled by the tread rollers crosses the endless path to be travelled by the tread chain rollers or the endless path of the tread element, even in horizontal sections were the cantilever arm pivots significantly with respect to the tread element, compared to its position in steepest inclined sections. Rather, the tread rollers may travel within the endless loop defining the path of the tread chain rollers and the tread elements. Therefore, no additional space is required in lateral direction for the tread rollers. Rather, the tread rollers can engage with a second guide element of the people conveyor (e.g. a second guide rail) completely located within the endless path of the first guide element for supporting and guiding the tread chain rollers.

Principally, the tread rollers may be located on the laterally inner side of the cantilever arm, or on the laterally outer side of the cantilever arm. Providing the tread rollers on the laterally inner side of the cantilever arm has the advantage that any potential interferences with a drive sprocket, or other drive means for the tread chain, can be avoided, since the tread rollers and the second guide element are located on the opposite side of the cantilever arm with respect to the drive engaging the tread chain rollers.

In particular embodiments, the tread chain may comprise a plurality of tread chain roller supporting elements, each tread chain roller supporting element being connected to a respective one of the tread chain links or tread chain pins and supporting at least two tread chain rollers. Particularly, each of the tread chain roller supporting elements may be supported by a respective tread chain pin, and may extend in direction of the step chain links. The tread chain roller supporting element may be supported such as to be pivotable with respect to the tread chain links. Each of the least two tread chain rollers might be supported by the tread chain roller supporting elements at one of the longitudinal ends thereof. Using tread chain roller supporting elements supporting at least two tread chain rollers allows to reduce the effective number of tread chain rollers by a factor of at least two compared to the number of tread chain links. Since tread chain rollers support and guide the tread chain as well as engage with the drive sprocket, the load to be supported by each single tread chain roller may be reduced. Moreover, also the effective tread chain pitch may be reduced compared to a conventional tread chain having the same number of tread chain rollers as tread chain links. The reduction in effective tread chain pitch results in an efficient suppression of the polygon effect which might otherwise might become important for configurations where the tread chain pitch becomes large and correspondingly the number of teeth on the drive sprocket becomes small. For a more detailed description of a drive chain using tread chain supporting elements according to embodiments, reference is made to applicant's co-pending international patent application No. PCT/EP2014/076209, the disclosure of which is incorporated herein by reference.

The embodiments described above are particularly well suited for a people conveyor, particularly an escalator or a moving walkway, comprising an endless tread band formed by a plurality of the tread elements connected to each other and driven by at least one tread chain between a downstream and an upstream turnaround section, the tread elements having a configuration as set out in any of the previous claims, said people conveyor further comprising: a drive configured to engage the drive chain such as to drive the drive chain around a first endless path between the first and second turnaround sections; a first guide element for guiding movement of the tread chain along a first endless path between the first and second turnaround sections; and a second guide element for guiding movement of the tread rollers along a second endless path between the first and second turnaround sections; the second guide element having a configuration such that the second endless path extends inside or outside the first endless path formed by the first guide element, when seen in a side elevation view. When looking towards the people conveyor from the side in a horizontal direction, the second endless path extends inside or outside the path formed by the first guide element, but does not cross the the path formed by the first guide element.

As a consequence, the first guide element and the second guide element do not cross each other when seen in an elevation view. This allows that the first guide element and second guide element may extend in a same plane when seen in a lateral direction without interfering with each other. Particularly, the second guide element may extend completely inside the endless loop defined by the first guide element in an elevation view.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

LIST OF REFERENCE SIGNS

10 people conveyor
12 tread element, in particular step
14 tread
16 riser
18 riser panel
20 lateral side panel
22 tread chain, in particular step chain
**22*i*** inner link plate
**22*o***: outer link plate
24 tread chain link, in particular step chain link
26 tread chain pin, in particular step chain pin
28 tread chain axle, in particular step chain axle
**28*a*** first section of tread chain axle
**28*b*** second section of tread chain axle
**28*c*** third section of tread chain axle
30 endless tread band, in particular endless step band
32 tread chain roller, in particular step chain roller
34 endless track of step chain rollers defined by first guiding means
36 endless track of tread rollers defined by second guiding means
38 bottom panel
40 cantilever arm
**40*a*** first section of cantilever arm
**40*b*** second section of cantilever arm
**40*c*** third section of cantilever arm
42 tread roller
α first crank angle of cantilever arm
β second crank angle of cantilever arm
L longitudinal extension of cantilever arm
X distance between adjacent step chain axles
50 step chain roller supporting element

The invention claimed is:

1. A tread element for a passenger conveyor; the tread element comprising a tread defined by a front side, a rear side, a first lateral side and a second lateral side;

a riser comprising a riser panel adjacent the rear side of the tread and pivotably connected to the tread;

at least one tread chain axle adapted to connect the tread element to at least one tread chain;

at least one tread roller adapted to engage with a guide element of the passenger conveyor to adjust the position of the tread with respect to the riser; and at least one cantilever arm comprising a hole or recess for connecting to the at least one step chain axle in a torque proof manner so that the at least one cantilever arm is supported at its one longitudinal side by the tread chain axle, the at least one cantilever arm supporting the tread roller at its opposite longitudinal side;

wherein a distance (L) between the tread chain axle supporting the at least one cantilever arm and the tread roller supported by the same cantilever arm is larger than a distance (X) between the tread chain axle of the tread element and the tread chain axle of an adjacent tread element in the endless tread chain of a people conveyor.

2. The tread element according to claim 1, wherein the riser comprises a first lateral panel extending along the first lateral side of the tread and a second lateral panel extending along the second lateral side of the tread; the first lateral panel supported pivotably with respect to the tread by a first pivot located on the first lateral side of the tread; the second lateral panel supported pivotably with respect to the tread by a second pivot located on the second lateral side of the tread; the first and second pivots located opposite to each other adjacent to the front side of the tread.

3. The tread element according to claim 1, wherein the riser panel has a concave shape.

4. The tread element according to claim 1, wherein the riser comprises a bottom panel extending from the riser panel towards the front side of the tread.

5. The tread element according to claim 1, comprising a pair of cantilever arms, one cantilever arm located on each lateral side of the tread and extending along the lateral side of the tread.

6. The tread element according to claim 1, wherein the cantilever arm has a cranked shape.

7. The tread element according to claim 6, wherein the cantilever arm has a first crank between a first longitudinal end section (40*a*) of the cantilever arm supported by the tread chain axle and a central section (40*b*) of the cantilever arm, and a second crank between the central section (40*b*) of the cantilever arm and a second longitudinal end section (40*c*) of the cantilever arm supporting the tread roller, the first crank defining a crank in a first direction and the second crank defining a crank in a second direction opposite to the first direction.

8. The tread element according to claim 5, comprising a pair of tread chain axles, each tread chain axle supporting a respective one of the cantilever arms on opposite lateral sides of the tread element.

9. The tread element according to claim 1, wherein the tread chain axle is connected to the tread in a torque-proof manner and is connected to the cantilever arm in a torque-proof manner, and wherein the riser is pivotably supported by the tread chain axle.

10. The tread element according to claim 1, wherein the tread chain comprises tread chain links connected to each other by tread chain pins, the tread chain axle including a section adapted to engage with one of the tread chain pins or forming one of the tread chain pins.

11. The tread element according to claim 2, wherein the lateral panels of the riser are formed integrally with respective tread chain links (24*i*).

12. The tread element according to claim 11, wherein the tread chain links are made up with pairs of tread chain link plates connected to each other by respective tread chain pins, the laterally inner link plate of each tread chain link being formed by, or integrally with, the respective lateral panel member.

13. The tread element according to claim 12, wherein the cantilever arm and/or the tread roller is positioned in a gap formed in between the two link plates of a pair of link plates forming a respective tread chain link.

14. The tread element according to claim 1, wherein the cantilever arm is supported laterally inwardly of the laterally outer side of the tread chain.

15. The tread element according to claim 1, wherein a tread chain roller is supported on a laterally outer side of the cantilever arm.

16. The tread element according to claim 1, wherein a tread chain roller is supported laterally inwardly of the laterally outer side of the tread chain.

17. The tread element according to claim 1, wherein the tread roller is supported on a laterally inner side of the cantilever arm.

18. The tread element according to claim 10, wherein the tread chain comprises a plurality of tread chain roller supporting elements, each tread chain roller supporting element being connected to a respective one of the tread chain links or tread chain pins and supporting at least two tread chain rollers.

19. A people conveyor, particularly an escalator or a moving walkway, comprising an endless tread band formed by a plurality of the tread elements connected to each other and driven by at least one tread chain between a downstream and an upstream turnaround section, the tread elements having a configuration as set out in claim 1, said people conveyor further comprising:

a drive configured to engage the drive chain such as to drive the drive chain around a first endless path between the first and second turnaround sections;

a first guide element for guiding movement of the tread chain along the first endless path; and a second guide element for guiding movement of the tread rollers along a second endless path between the first and second turnaround sections;

the second guide element having a configuration such that the second endless path extends completely inside or completely outside the first endless path in a side elevation view.

20. The people conveyor according to claim 19, wherein the second endless path extends inside the first endless path in a side elevation view.

* * * * *